United States Patent [19]

Burton, Jr.

[11] Patent Number: 4,852,784

[45] Date of Patent: Aug. 1, 1989

[54] HANDCUFF HOLDER

[76] Inventor: Willie L. Burton, Jr., 4321 7th St. N.W., Washington, D.C. 20011

[21] Appl. No.: 301,137

[22] Filed: Jan. 25, 1989

[51] Int. Cl.[4] ..... A45F 5/00

[52] U.S. Cl. ..... 224/255; 224/914

[58] Field of Search ..... 224/182, 191, 192, 196, 224/197, 198, 199, 224, 227, 252, 271, 911, 914, 151, 206, 268, 269, 255

[56] References Cited

U.S. PATENT DOCUMENTS

| | | | |
|---|---|---|---|
| 1,413,290 | 4/1922 | O'Leary | 70/17 |
| 1,517,588 | 12/1924 | Sasaki | 224/914 |
| 1,894,540 | 1/1933 | Peirce | 224/914 |
| 2,037,132 | 4/1936 | Hoyt | 224/914 |
| 3,826,414 | 7/1974 | Valadez | 224/231 |
| 3,870,208 | 3/1975 | Theodore | 224/250 |
| 4,408,706 | 10/1983 | Hurley | 224/911 |
| 4,750,652 | 6/1988 | Grant | 224/151 |

*Primary Examiner*—Henry J. Recla
*Assistant Examiner*—Glenn T. Barrett

[57] ABSTRACT

A handcuff holder that attaches to a handgun holster for the purpose of keeping the handcuffs and handgun together. The handcuff holder is attached to the handgun holster by a clip and a piece of leather or similar material that is stitched to the handgun holster. The holder further comprises a vertically extending metal piece having an open area and a strap for releasably securing a pair of handcuffs to the holder.

1 Claim, 1 Drawing Sheet

HANDCUFF HOLDER

FIELD OF THE INVENTION

The present invention relates to a handcuff holder that will attach to a handgun holster for the purpose of keeping the handcuffs and handgun together and will not interfere with the insertion or removal of either (handgun or handcuffs).

HISTORY OF THE INVENTION

It is commonly known by law enforcement personnel that a great deal of officers who perform duties in nonuniform, and officers that are off duty find the several below cited traditional methods of carrying handcuffs to be uncomfortable and burdensome: When placed in the waistband, placed on the waistbelt or placed in the pocket. Some other reasons cited for the prior art not being satisfactory: The handcuffs are noisy, and officers frequently forget to transfer them from their on duty apparel to their off duty apparel.

The present invention relates to a handcuff holder that attaches to most handgun holsters worn by law enforcement personnel. The method of attaching a handcuff holder to a handgun holster is believed to be a new concept over the prior art.

It is therefore an object of the present invention to keep the handcuff holder together with the handgun holster.

It is also the object of the invention to keep the handcuffs together with the handgun.

It is also an object of this invention to be operated with the wearer's predominant hand.

Still further, an object of the invention is to allow the handcuffs to be released for use in an uncomplicated fashion by a simple fastener snap.

And even still further, it is an object of this invention to provide on duty uniformed officers a method of carrying an additional set of handcuffs.

SUMMARY OF THE INVENTION

According to the aforementioned and other objects, the present invention provides a handcuff holder that attaches to a handgun holster. The handcuff holder is attached to the handgun holster by a metal clip and a patch that is stitched to the handgun holster.

The holder is comprised of two pieces. A metal piece that extends vertically down the side of the holster that is facing farthest away from the wearer's body with a clip on the back to assist in securing it to the holster. At the bottom of the holder is an open groove that holds the lower jaws and frames of the handcuffs. The other piece of the holder is a leather strap or similar material that is attached to the metal piece by a metal stud. The strap passes across the upper side of the handcuffs' frame that is facing farthest away from the wearer's body and continues over the top of the handcuffs and fastens to the metal piece of the holder via a fastener snap and a rivet, thereby, securing the handcuffs firmly in the holder. The handcuffs come instantly free for use with the releasable fastener snap.

Other objects of the current invention will be apparent from the following description and drawings.

DESCRIPTION OF PREFERRED EMBODIMENTS

Figure 1:
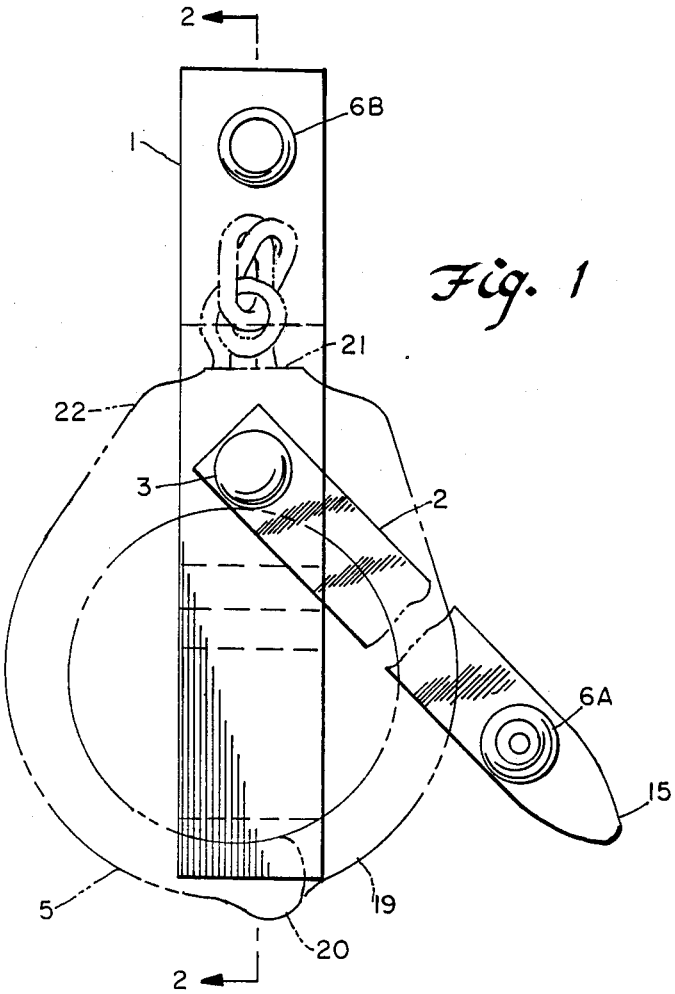
FIG. 1 is a front view of the present handcuff holder with handcuffs and also showing strap unfastened.
Figure 2:
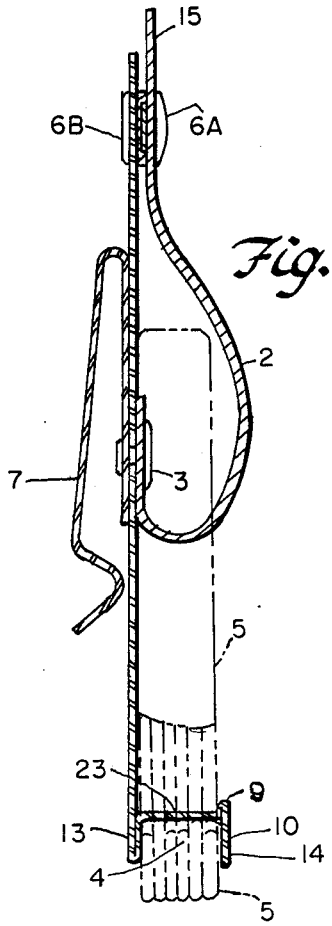
FIG. 2 is a side view of the present handcuff holder with handcuffs attached and strap fastened.
Figure 3:
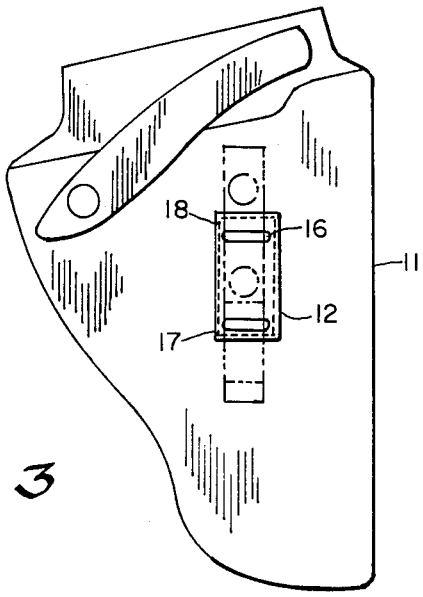
FIG. 3 is a front view of the handcuff holder attached to the handgun holster by way of a leather patch.

Referring to the drawings, the handcuff holder 1 comprises of a strap 2, an open area 4 at the bottom of the holder which is located between two guard rails 13 and 14. On the back of the holder, a clip 7 is provided.

The strap's lower part is permanently fixed to the holder 1 by a metal rivet 3 that penetrates through the strap's lower part and is lodged in the holder 1. The fastener snap *6a* near the top of the strap 2 has a tab 15.

The clip 7 is fixed to the back of the holder 1 by inserting it through openings in a leather patch 12. The patch has an opening 16 near the top of the patch and an opening 17 near the bottom of the patch. The leather patch 12 is stitched 18 to the handgun holster 11, thereby, completing the securing of the patch 12 and holder 1 to the holster 11.

The handcuffs' 5 lower jaws 19 and lower frames 20 are placed in the open area 4 between the two guard rails 13 and 14. The rails are spaced far enough apart for the lower parts of the jaws 19 and frames 20 of the handcuffs 5 to fit slightly loose in the open area 4 between the two guard rails 13 and 14. The handcuffs' top part 21 is secured to the holder 1 by the fastener snap *6a* near the top of the strap 2. The strap 2 passes under the engaging part 22 of the handcuffs 5 and up the exposed side of the engaging part 22 of the handcuffs 5 and over the top of the handcuffs 5, and fastens to a snap *6b* that is fixed to the upper part of the holder 1. The handcuffs 5 are released from the holder 1 by pulling the tab 15 which disengages the fastener snap *6a* from the snap *6b* that is fixed to the holder 1.

I claim:

1. In combination a handgun holster and a handcuff holder, said holster having an outer surface, said handcuff holder including retaining means for releasably retaining a pair of handcuffs and attachment means for removably attaching said handcuff holder to said outer surface of said holster.

* * * * *